United States Patent [19]

Lawniczak et al.

[11] Patent Number: 5,074,543

[45] Date of Patent: Dec. 24, 1991

[54] HOPPER ASSEMBLY FOR SELECTIVELY RESTACKING BOTH INDIVIDUAL ORIGINALS AND FAN-FOLDED ORIGINALS RECEIVED FROM A DOCUMENT REPRODUCTION MACHINE

[75] Inventors: Gary P. Lawniczak; Richard S. Perriello, both of Rochester; Floyd E. Stearns, Warsaw, all of N.Y.

[73] Assignee: Eastman Kodak Company, Rochester, N.Y.

[21] Appl. No.: 612,740

[22] Filed: Nov. 14, 1990

[51] Int. Cl.[5] ..... B65H 31/22

[52] U.S. Cl. ..... 271/207; 271/213; 271/9

[58] Field of Search ..... 271/9, 207, 213, 220; 400/605, 646-647.1

[56] References Cited

U.S. PATENT DOCUMENTS

| | | | |
|---|---|---|---|
| 4,068,946 | 1/1978 | Eschweiller, Jr. et al. | 355/64 |
| 4,087,172 | 5/1978 | Van Dongen | 355/14 |
| 4,191,467 | 3/1980 | Shieck | 355/75 |
| 4,300,710 | 11/1983 | Du Bois et al. | 226/74 |
| 4,320,960 | 3/1982 | Ward et al. | 355/14 R |
| 4,334,764 | 6/1982 | Rawson et al. | 355/14 SH |
| 4,486,093 | 12/1984 | McNew | 355/29 |
| 4,714,946 | 12/1987 | Bajgert et al. | 355/75 |
| 4,754,960 | 7/1988 | Muller | 271/9 |
| 4,761,663 | 8/1988 | Piatt et al. | 271/9 |
| 4,982,945 | 1/1991 | Marasco et al. | 271/207 |

*Primary Examiner*—Robert P. Olszewski
*Assistant Examiner*—Steven M. Reiss
*Attorney, Agent, or Firm*—Lawrence P. Kessler

[57] ABSTRACT

A restacking hopper assembly selectively restacks individual originals and fan-folded originals as the originals emerge from a document reproduction machine. The hopper assembly includes a base securable to the reproducing machine at a location on the reproducing machine were copied originals emerge from the reproducing machine and a tray having first and second ends. The tray is pivoted to the base at the second end thereof adjacent the lower end of the base and pivots between a first mode for restacking individual originals in the tray and a second mode for restacking fan-folded originals on the tray. Devices associated with the base respectively facilitate restacking of individual originals and feed fan-folded originals in the tray. In accordance with a preferred embodiment, the tray includes a slot proximate first end thereof for restacking individual originals therein and a surface between the first and second ends of the tray for restacking fan-folded originals thereon.

25 Claims, 6 Drawing Sheets

HOPPER ASSEMBLY FOR SELECTIVELY RESTACKING BOTH INDIVIDUAL ORIGINALS AND FAN-FOLDED ORIGINALS RECEIVED FROM A DOCUMENT REPRODUCTION MACHINE

FIELD OF THE INVENTION

The instant invention relates to a document restacking hopper assembly for selectively restacking both individual original documents and fan-folded original documents after the documents have been reproduced by a document reproduction machine.

In an increasing number of business situations, it is necessary to copy continuous lengths of fan-folded computer data as well as individual documents. Where possible, it is desirable to utilize the same reproducing machine for both tasks since such machines are not inexpensive to own or lease. In configuring reproducing machines with the dual capability for copying both individual and fan-folded documents, it is, of course, desirable to integrate this capacity with reproducing machines in such a way as not to adversely affect, or substantially change, the operation of other components of the reproducing machines, whether the machines are new models just being introduced or currently available models.

The patent literature includes a number of references directed to reproducing machines which are capable of handling fan-folded original documents as well as original documents. U.S. Pat. No. 4,068,946 discloses a reproducing machine in which the capability of refolding fan-folded originals is built into the machine in such a way as to require alteration of other components of the machine, rather than being integrated in such a way as to not interfere with other components. U.S. Pat. No. 4,087,172 is directed to the broad concept of retrofitting a commercial photocopying machine to handle fan-folded originals as well as individual originals; however, the same hopper which collects fan-folded originals is not used to collect individual originals. Moreover, in this patent the hopper which is retrofitted to the reproducing machine has the characteristics of an "add-on", rather than the characteristics of an integral component.

U.S. Pat. No. 4,714,946 discloses a document-feeding arrangement which handles both fan-folded and individual documents; however, in this patent, separate trays or hoppers are used for collecting fan-folded documents and individual documents. Utilizing separate hoppers requires the operator of the reproducing machine to attach to the machine structure a device which is normally separate from the machine and, therefore, not integral with the machine.

U.S. Pat. Nos. 4,300,710; 4,320,960; 4,334,764 and 4,486,093 each further set forth the state-of-the-art of reproducing machines that are equipped to handle fan-folded originals as well as individual originals. In each case, however, the structure for accomplishing this is not integrated with the reproducing machine in such a way that the structure which catches the original documents is conveniently used for catching both individual and fan-folded originals.

SUMMARY OF THE INVENTION

It is an object of the instant invention to provide a new and improved hopper for selectively restacking both individual originals and fan-folded originals from a document reproducing machine.

In view of this object and other objects, the invention contemplates an apparatus for restacking both individual originals and fan-folded originals after copying by a reproducing machine wherein the apparatus comprises a hopper assembly having a tray with a first portion for restacking individual originals and a second portion for restacking fan-folded originals. The tray is movably mounted with respect to the reproducing machine for movement between a first mode, wherein the tray allows individual originals to be restacked therein, and a second mode, wherein the tray allows fan-folded originals to be restacked therein. Devices for facilitating restacking of individual and fan-folded originals are positioned upstream of the tray.

In a more specific aspect of the invention, the tray is pivotally mounted with respect to the reproducing machine.

In a preferred embodiment of the invention, the tray has a first end and a second end with a first portion for restacking individual originals being disposed at the first end and a second portion for restacking fan-folded originals being disposed between the first and second ends. At its second end, the tray is pivotally mounted with respect to the reproducing machine; whereby the tray is in the first mode for restacking individual originals when the first end is pivoted toward the reproducing machine, and is in a second mode for restacking fan-folded originals when the first end is pivoted away from the reproducing machine so as to expose the second portion of the tray.

The instant invention further contemplates a combination, which combination includes a reproducing machine for copying both individual originals and fan-folded originals and a restacking hopper assembly for restacking the originals after copying. The restacking hopper assembly includes a base securable to the reproducing machine at a location on the reproducing machine where copied originals emerge from the reproducing machine. A tray having first and second ends is pivoted at its second end to the base adjacent the lower end of the base. The tray pivots between a first mode for restacking individual originals in the tray and a second mode for restacking fan-folded originals in the tray. The restacking hopper assembly includes thereon devices for facilitating restacking of both individual and fan-folded originals.

In a more specific aspect of the combination, the tray receives individual originals proximate the first end thereof and receives fan-folded originals at a location between the first and second ends.

In accordance with a preferred embodiment, restacking of fan-folded originals is facilitated by a tractor assembly disposed in the base between the lower and upper ends thereof, with the tractor assembly being exposed for use upon pivoting the tray from the first mode, for restacking individual originals, to the second mode, for restacking fan-folded originals. Preferably, the base includes a slanted surface adjacent to the upper end thereof. Restacking of individual originals is facilitated by at least one flexible member overlying the slanted surface for retaining individual sheets between the slanted surface and the flexible member.

Preferably, the flexible member is mounted on a horizontal rod which is connected by a linkage to a vertical rod engageable by the tray as the tray pivots from the second mode to the first mode. Upon engagement by the tray, the vertical rod moves the horizontal rod to shift the flexible member from an operative to an inoperative position.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
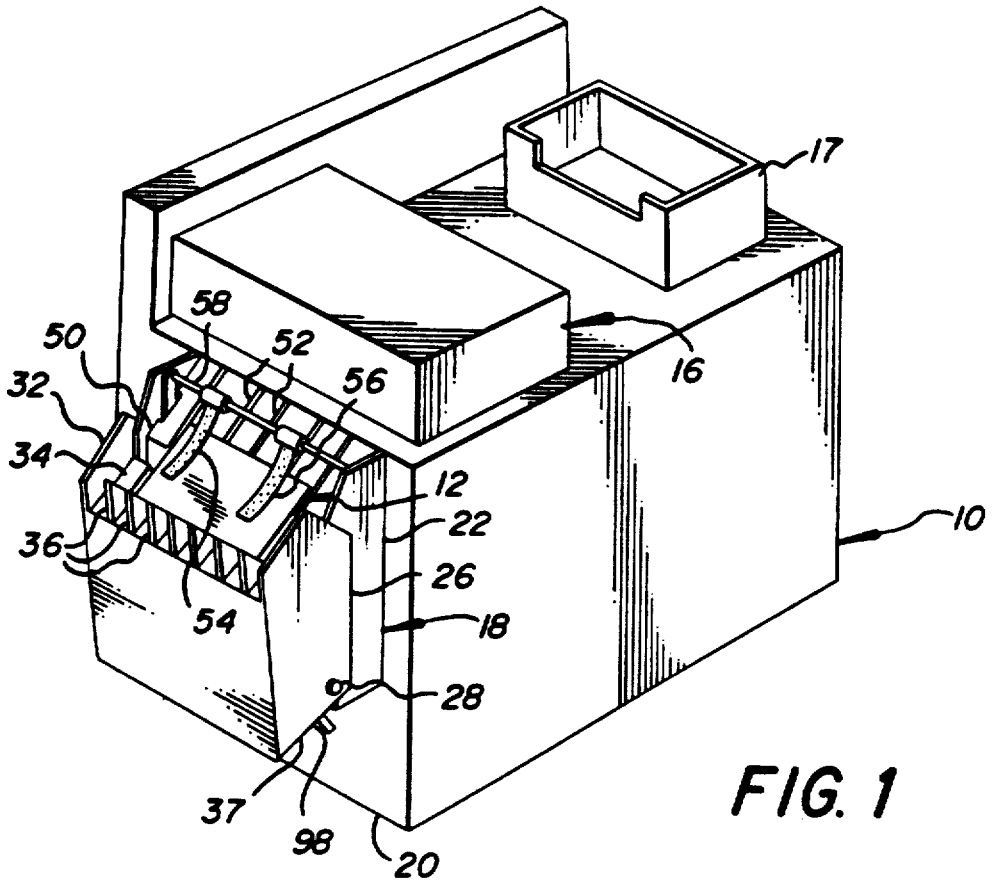
FIG. 1 is a perspective view of a document reproducing machine having attached thereto a restacking hopper assembly for collecting both individual originals and fan-folded originals, showing the hopper assembly in a first mode for restacking individual, single sheet originals after copying by the reproducing machine.

A. Relationship of Restacking Hopper Assembly 18 to Reproducing Machine 10 and General Structure of Tray 26

Referring now to mainly FIGS. 1–3, there is shown a reproducing machine, designated generally by the numeral 10, for reproducing images of either individual sheets of paper or the like 12, referred to hereinafter as individual originals, or continuous fan-folded webs of paper 14, referred to hereinafter as fan-folded originals. Fan-folded originals 14 are most often computer generated printouts. When making copies of computer generated printouts, it is necessary to unfold the fan-fold stack to reproduce images thereof, and thereafter it is highly desirable to restack the individual connected sheets in the original fan-folded configuration. Individual originals 12 are transported, for example, by an original positioner 16 mounted on top of the reproducing machine 10 and are restacked in the same order as copied, while fan-folded originals 14 are pulled from a basket 17 at the opposite end of the reproducing machine.

Restacking of original documents 12 and 14 after reproducing images thereof in the reproducing machine 10 is accomplished by a restacking hopper assembly, designated generally by the numeral 18, configured in accordance with the principles of the instant invention. The restacking hopper 18 assumes a first mode, shown in FIG. 1, for restacking individual originals 12 and a second mode, shown in FIGS. 2 and 3, for restacking fan-folded originals 14.

The restacking hopper assembly 18 is attached to a side panel 20 of the reproducing machine 10 and includes a vertically oriented base, designated generally by the numeral 22; a tractor feed, designated generally by the number 24, mounted within the base; and a tray, designated generally by the numeral 26, secured by pivot pins 28 and 30 to the base. Tray 26 is in a first mode for restacking individual originals 12 in FIG. 1, and in FIGS. 2 and 3, has pivoted on pivot pins 28 and 30 to a second mode for restacking fan-folded originals 14.

A first end 32 of the tray 26, includes a groove 33 defined by first and second sets of spaced apart, aligned flanges 34 and 36 while a second end 37 of the tray 26 is secured to the base 22 by the pivot pins 28 and 30. As is more clearly shown in FIG. 5, each of the flanges 34 is a flat plate having a first flat surface 38 facing inwardly to define a plane forming one side of the groove 33 and a second flat surface 42 which faces the vertical base 18. The plane defined by the flat surfaces 38 extends parallel with respect to the axis 28–30 about which the tray 26 pivots and is at an oblique angle to the vertical when the tray 26 is in the first mode of FIG. 1. The second flanges 36 are triangular plates having edges 44, which edges face the surfaces 38 at an acute angle to the second side of the groove 33. The plates 36 have spaces 46 (FIGS. 1–3) therebetween, while the plates 34 have spaces 48 therebetween with the spaces 46 being aligned with plates 34 and the spaces 48 being aligned with plates 36.

B. The Restacking Hopper Assembly 18 in First Mode for Restacking Individual Originals 12 (FIGS. 1, 4 and 6)

Figure 4:
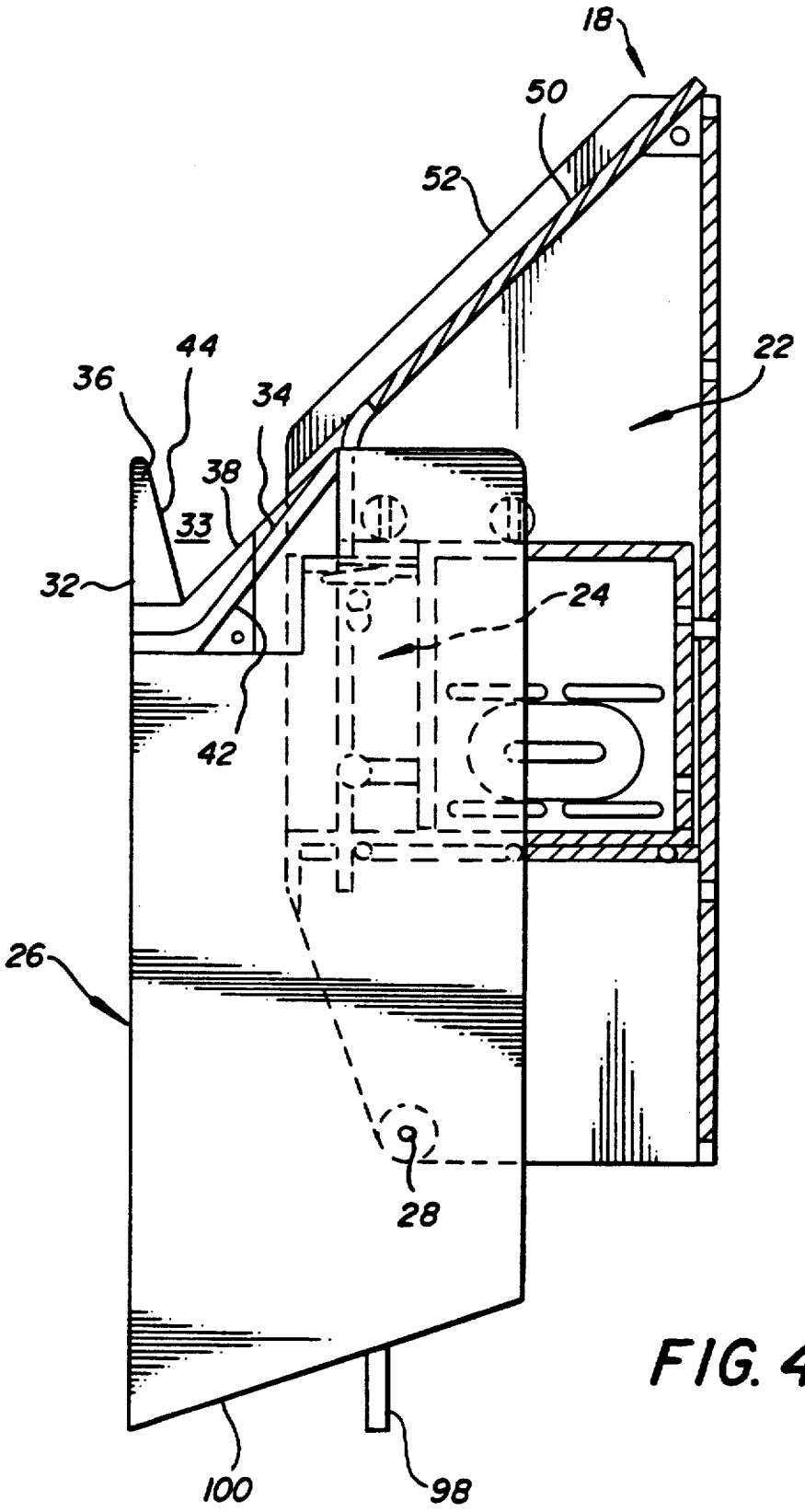
FIG. 4 is a side view of the hopper assembly in its first mode.

As is seen in FIGS. 1 and 4, when the tray 26 is in its vertical orientation, the hopper assembly 18 is in the first mode for restacking individual originals 12, wherein the flanges 34 are oriented at an angle with respect to the base 22 and slant in the same direction as a paper slide surface 50 on the base. The paper slide surface 50 has a plurality of ribs 52 over which the individual originals 12 slide after being copied and ejected from the positioner 16.

Figure 6:
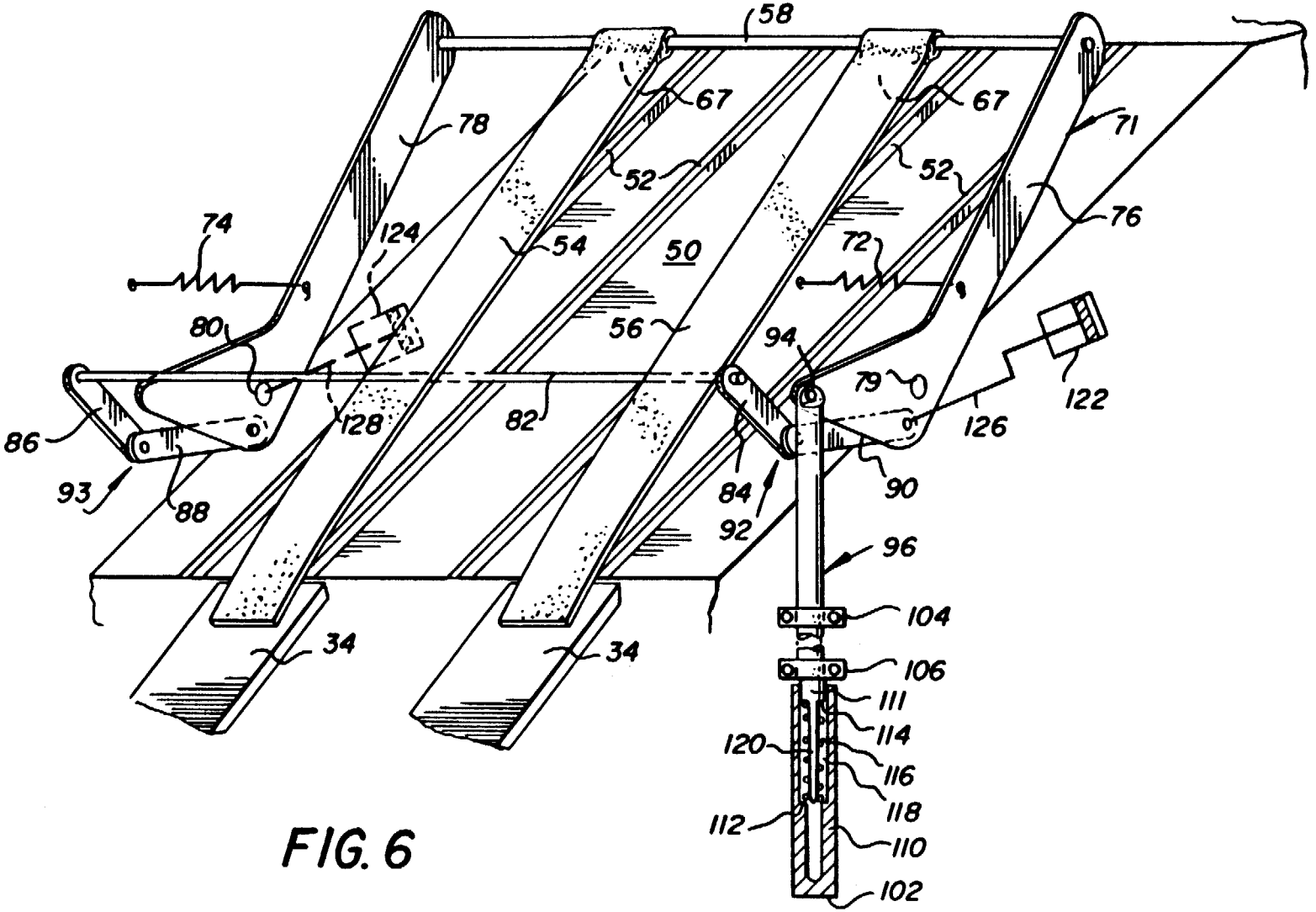
FIG. 6 is a perspective view of a dangler mechanism of the instant invention is an operational mode assumed when the restacking hopper assembly is in the first mode of FIG. 1.
Figure 7:
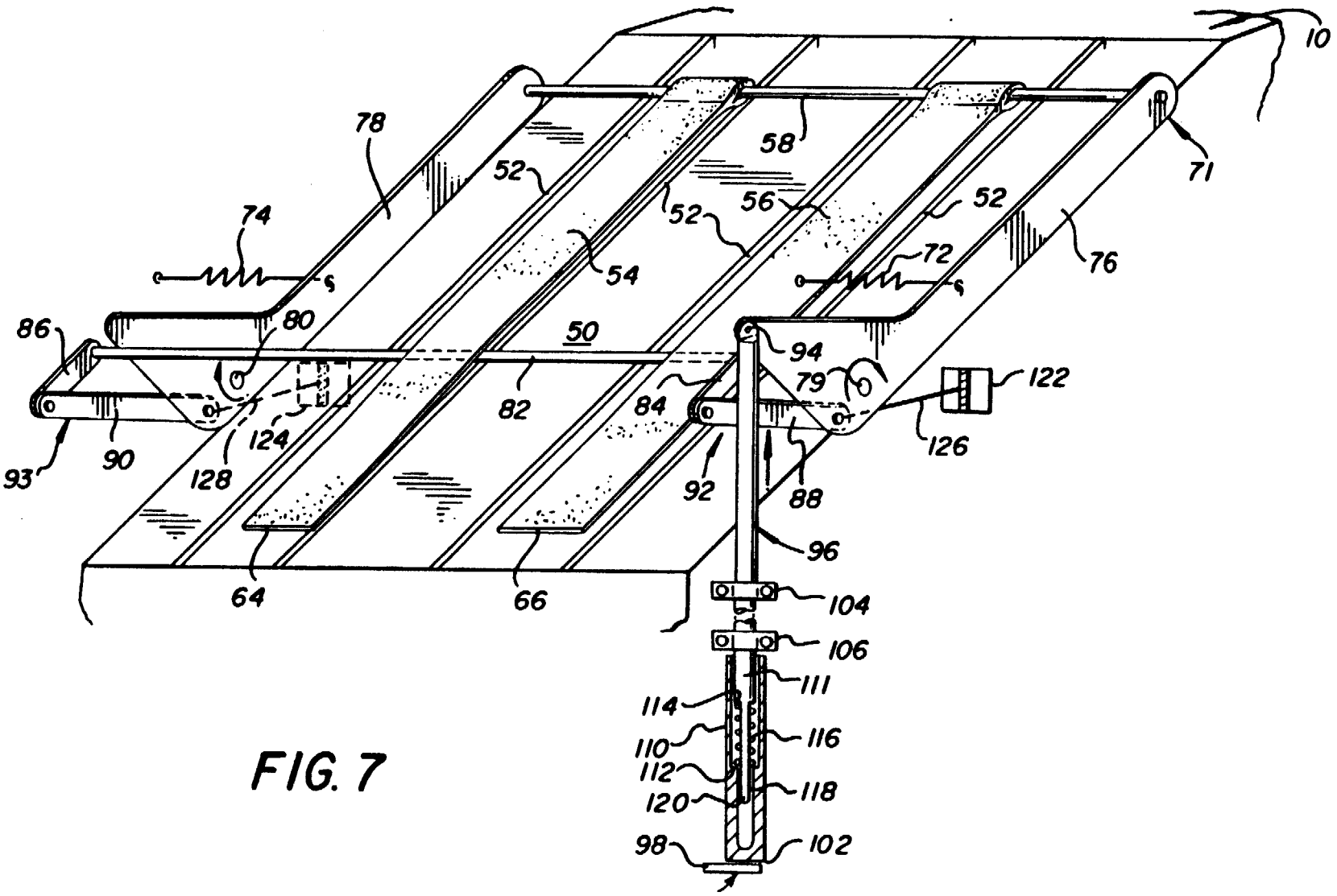
FIG. 7 is a view similar of FIG. 6, but showing the dangler mechanism in its retracted mode, which is assumed when the hopper assembly is in its second mode for collecting fan-folded documents as shown in FIGS. 2 and 3.

As is best seen in FIG. 6, a pair of spaced danglers 54 and 56, made of flexible material, are pivoted on a rod 58 which holds the attached ends of each dangler in spaced relation with respect to the paper slide surface 50. The free ends of the danglers 54 and 56, respectively, rest on two of the flanges 34 at the upper or first end 32 of the tray 26 so as to form a converging guide which retains first and subsequent individual originals 12 in a space 67 between the danglers and paper slide 50 to keep the individual originals from falling out o the groove 33. As will be explained in more detail hereinafter, the danglers 54 and 56 have an operative mode (FIGS. 1 and 6) and a retracted mode (FIGS. 2, 3 and 7).

C. The Restacking Hopper Assembly 18 in Second Mode for Restacking Fan-Folded Originals (FIGS. 2, 3, 5 and 7)

As is seen in FIGS. 2, 3, 5 and 7, when it is desired that the hopper assembly 18 function in its second mode for restacking the fan-folded original 14 after the original has been copied by the reproducing machine 10, the tray 26 is pivoted about pivots 28 and 30 away from the vertically oriented base 22 and extends approximately 90° with respect thereto. When the hopper assembly 18 is in the second mode, the tray 26 provides a second original document restacking portion, defined by a horizontal support surface 60 created by a grid of ribs 61, upon which the fan-folded original 14 is refolded after copying by the machine 10.

After the tray 26 has been pivoted to place the hopper assembly 18 in the second mode, retaining arms 64 and 66 on the tractor mechanism 24 are pivoted outwardly (see FIG. 2) so as to receive one panel of the fan-folded original 14 therebetween. The retaining arms 64 and 66 are then pivoted back over the original 14 (see FIG. 3) to hold the original in engagement with sprockets 69 and 70 (see FIG. 2) of the tractor assembly 24. The tractor assembly 24, including its drive motor M is of conventional construction and other than nesting in the vertical base 22 so as to cooperatively function with the hopper assembly 18, the tractor assembly functions in a conventional manner to pull and guide the fan-folded original 14 after it has been copied.

Figure 2:
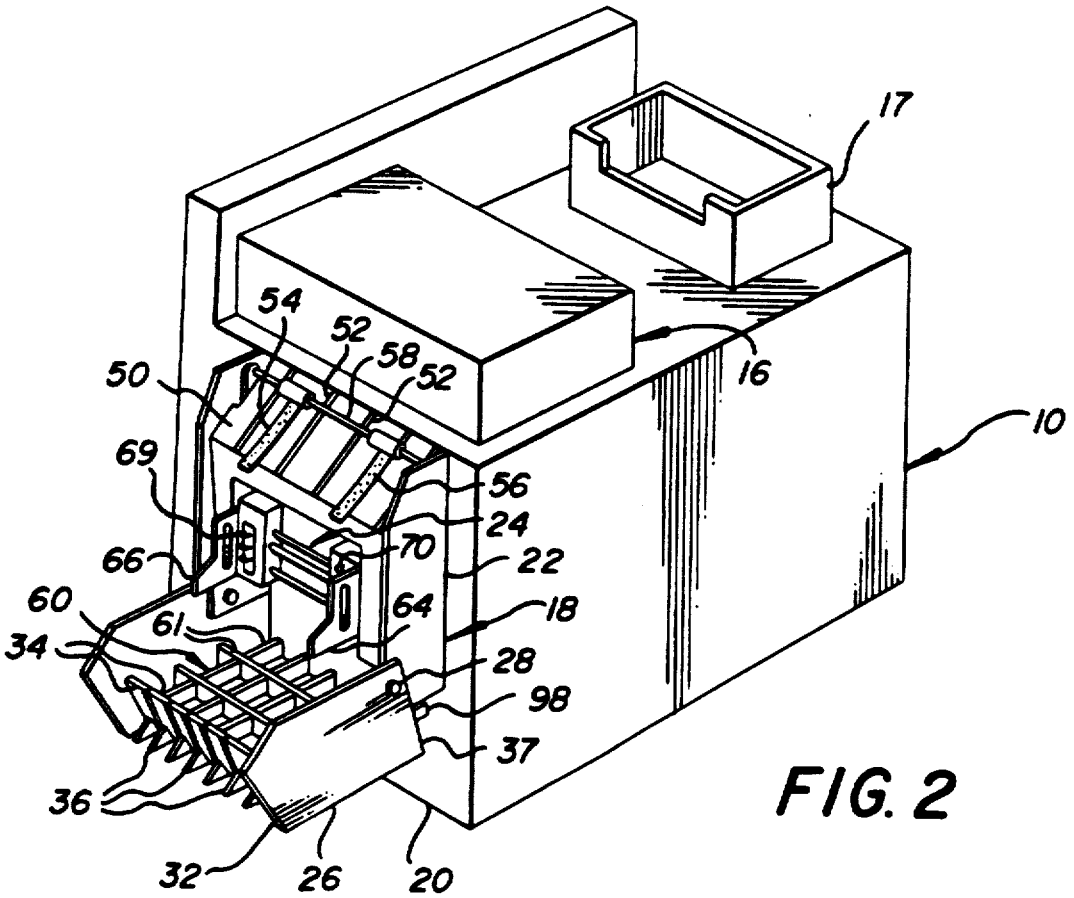
FIG. 2 is a view similar to FIG. 1, but showing the restacking hopper assembly in a second mode ready to receive fan-folded originals after copying by the photocopying machine.
Figure 3:
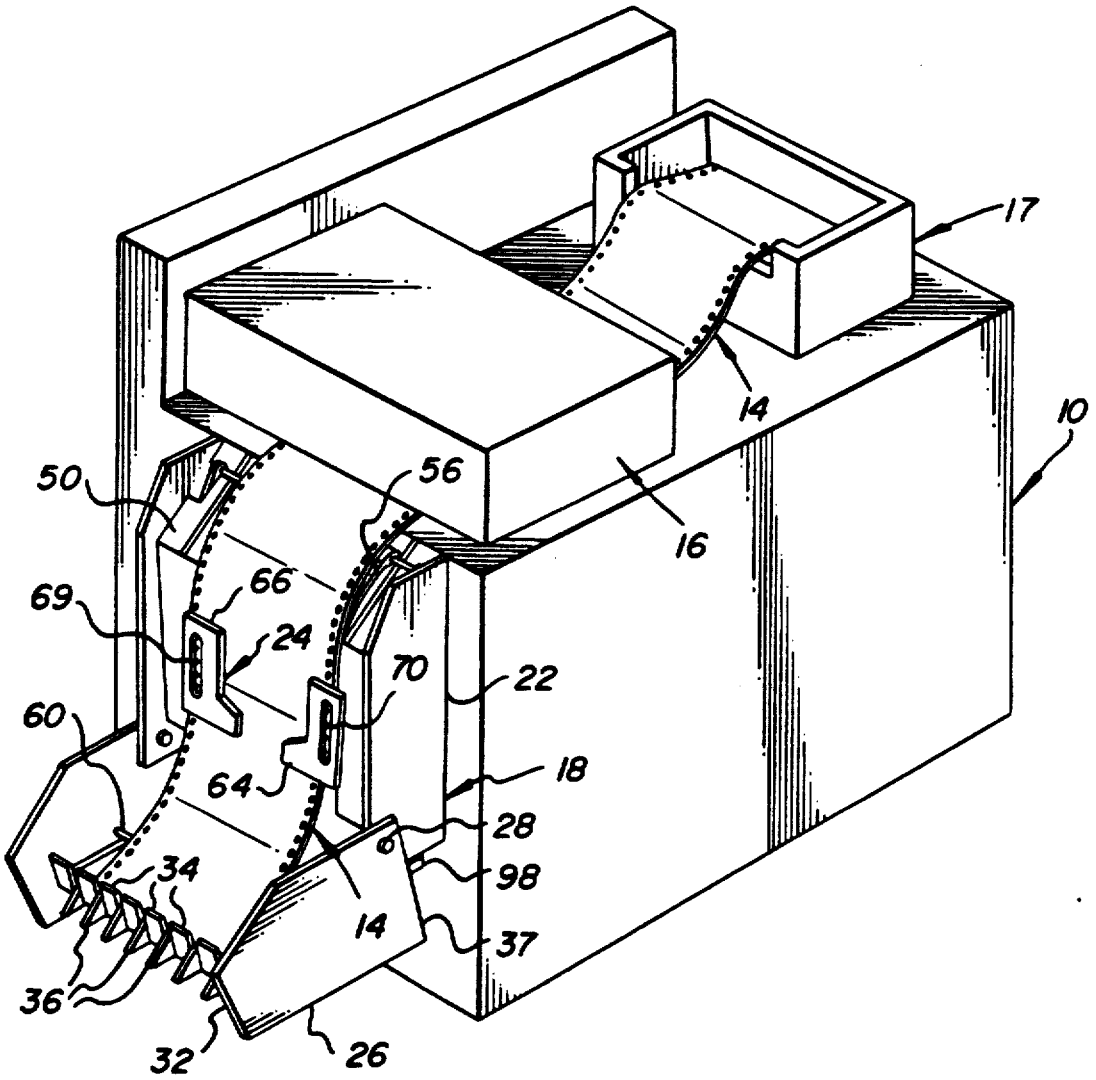
FIG. 3 is a view similar to FIG. 2 showing the restacking hopper assembly in the second mode and accumulating a fan-folded original after reproduction by the reproducing machine.
Figure 5:
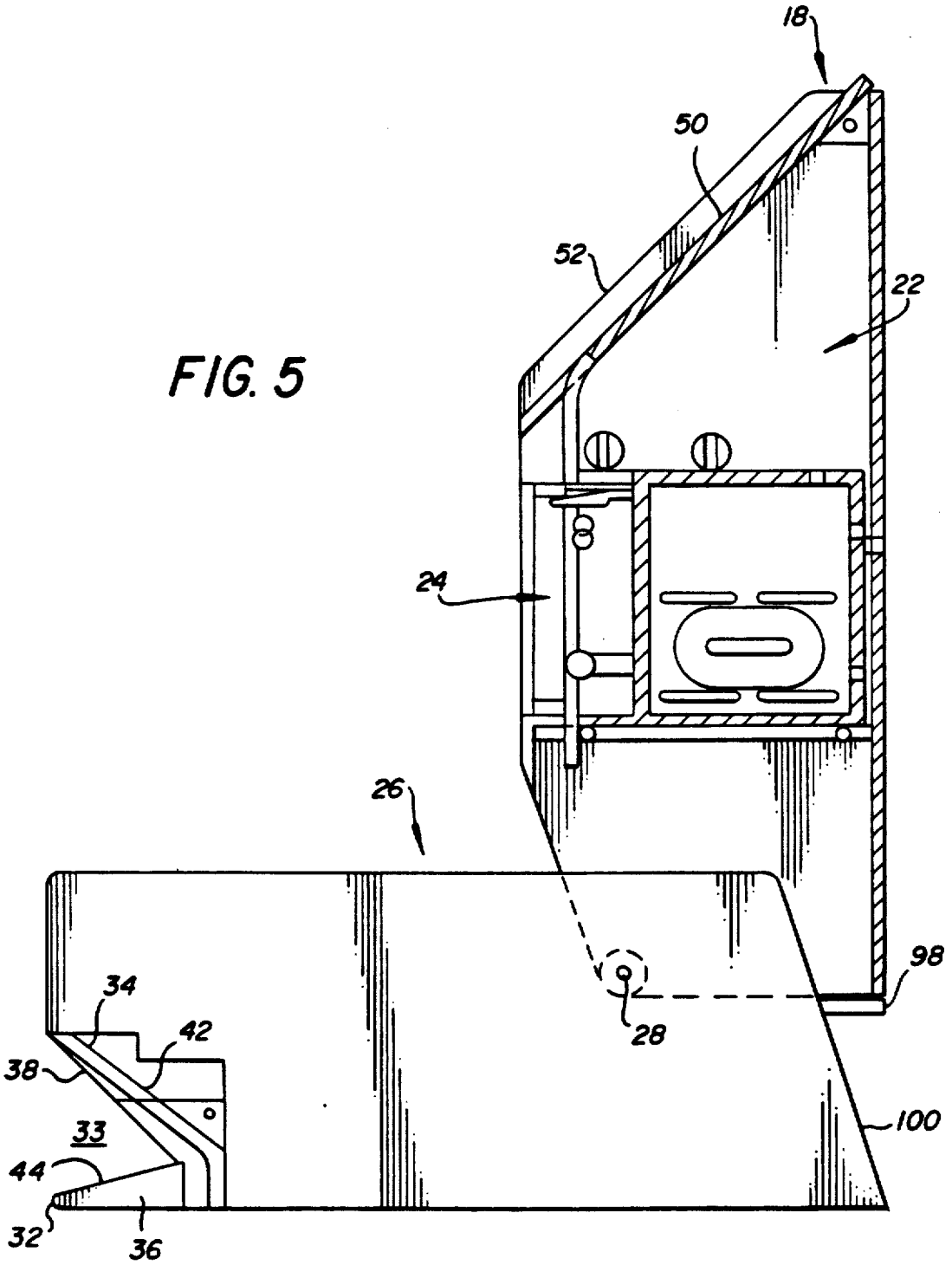
FIG. 5 is a side view of the hopper assembly in its second mode.

When the tray 26 is pivoted to the second mode illustrated in FIGS. 2, 3 and 5, the tray operates a dangler retraction mechanism, designated generally by numeral 71 (FIGS. 6 and 7) which causes the rod 58, holding the danglers 54 and 56, to retract to a non-operative mode where the danglers rest against the surface 50 between pairs of ribs 52. The fan-folded original 14 then passes over the danglers 54 and 56 as it emerges from the reproducing machine 10 and collects on top of the grid 61 defining the second document receiving portion of the tray 26. The web paper of which the fan-folded original 14 is formed, automatically fan-folds itself as it emerges from the tractor assembly 24 due to the opposite fold biases in successive creases of the fan-folded original, which biases remain after the fan-folded original has been unfolded for copying.

D. Operation of the Dangler Retraction Mechanism 71 (FIGS. 6 and 7)

As is seen in FIG. 6, when the hopper assembly 18 is in its first mode, the danglers 54 and 56 are projected as is shown in FIGS. 1 and 6 by a dangler retraction mechanism, designated generally by the numeral 71. This is because tensioned coil springs 72 and 74 urge a pair of arms 76 and 78, connected to one another by the rod 58, to rotate in a counterclockwise direction about pivots 79 and 80. When in the operative mode of FIG. 6, the rod 58 is lifted away from the slide surface 50 and the ribs 52 thereon so as to define the space 67 between the flexible danglers 54 and 56 and the surface and ribs. The arms 76 and 78 are connected to and rotated simultaneously with one another by a shaft 82 journaled for rotation on the base 22 of the restacking assembly hopper 18. Fixed to opposite ends of the shaft 82 are crank arms 84 and 86, which are in turn connected by pivoted links 88 and 90 to the arms 76 and 78, respectively. The crank arms 84, 86 links 88, 90 and arms 76, 78 form four-bar linkages 92 and 93 for rotating the arms 76 and 78 simultaneously.

Pivoted to the arm 76 by pivot pin 94 is a pushrod assembly, designated generally by the numeral 96. Movement of the pushrod assembly 96 in the vertical direction causes the arm 76 to rotate counterclockwise about the pivot 79 which also causes the arm 78, on the opposite side of the restacking hopper assembly 18, to rotate about its pivot 80 in that the arms are fixed to one another via rod 82.

As is seen in FIG. 7, when the pushrod assembly 96 is moved in the upward direction, the springs 72 and 74 are tensioned. When the pushrod assembly 96 is allowed to move in the downward direction, springs 72 and 74 contract and rotate the arms 76 and 78 counterclockwise about pivot pins 79 and 80 so as to move rod 58 to a position where danglers 54 and 56 project downwardly over the flanges 34 as is seen in FIGS. 1 and 6.

The pushrod assembly 96 is moved by a tab 98 which projects from the second end 37 of pivoted tray 26 and engages the bottom end 102 of the pushrod assembly. The pushrod assembly 96 is restrained by guides 104 and 106 to slide longitudinally when the tab 98 engages the bottom end 102 of the pushrod assembly. The bottom end 102 of the pushrod assembly 96 is formed on a sleeve 110 into which an elongated rod portion 111 of the pushrod assembly 96 telescopes. The sleeve 110 and elongated rod portion 111 have opposing shoulders 112 and 114, respectively. Between the shoulders 112 and 114 is a coil spring 116 which compresses as the bottom end 102 of the pushrod assembly 96 moves the sleeve 110 vertically against the bias of the spring. In order to accommodate relative movement between the elongated rod portion 111 and end sleeve 110, the sleeve has a bore 118 which receives an end portion 120 of the elongated rod portion. The spring 116 absorbs the initial impulse imparted by engagement of the tab 98 and the bottom end 102 of the pushrod assembly 96 so that the arms 76 and 78 do not snap rapidly back to the retracted position of FIGS. 2, 3, 5 and 7, but rather move smoothly back to the retracted position.

When the tray 26 moves from the second mode of FIGS. 2 and 3 back to the first mode of FIG. 1, disengagement of the tab 98 and the end 102 of the pushrod 96 allows springs 72 and 74 to rotate the arms 76 and 78 counterclockwise. In order to avoid snapping of the arms 76 and 78 from the FIG. 2 to the FIG. 1 position, dash pots 122 and 124, anchored to the vertical base 22, are connected via links 126 and 128 to pivots on the arms 76 and 78. Springs 72 and 74 rather slowly overcome the resistance of the dash pots 122 and 124 so as to move the arms 76 and 78, and thus rod 58 and associated danglers 54 and 56 to the projected position at a relatively slow rate.

While four-bar linkages 92 and 93 are shown for connecting the arms 76 and 78 to one another through the shaft 82, it is also possible to utilize other arrangements, such as gears (not shown) fixed to the ends of the shaft 82 and meshed with arcuate segments (not shown) formed on the arms 76 and 78, whereby rotation of one of the arms rotates the other arm via rotation of the gears fixed to the shaft.

The aforedescribed restacking hopper assembly 18 for restacking individual originals 12 and fan-folded originals 14 is readily integrated with a reproducing machine, such as the machine 10, and does not adversely affect or alter the operation of other components of the machine. The restacking hopper assembly 18 provides reproducing machines with a single apparatus mounted thereon which readily restacks either individual originals 12 or fan-folded originals 18.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Apparatus for restacking both individual originals and fan-folded originals after copying by a reproducing machine, comprising:

a tray having a first portion for restacking individual originals and a second portion for restacking fan-folded originals;

means for feeding fan-folded originals;

means for movably mounting the tray with respect to the reproducing machine for movement between a first mode, wherein the tray is positioned to enable individual originals to be restacked in the first portion thereof, and a second mode wherein the tray is positioned to enable fan-folded originals fed by said fan-fold feeding means to be restacked in the second portion thereof; and means for facilitating restacking of individual originals.

2. The apparatus of claim 1, wherein the means for movably mounting the tray comprises pivot means for pivoting the tray with respect to the reproducing machine.

3. The apparatus of claim 2, wherein the tray has a first end and a second end, the pivoting means being proximate the first end; and wherein the first portion of the tray for restacking individual originals is proximate the second end and the second portion of the tray for restacking fan-folded originals is positioned between the first and second ends; whereby the tray is in the first mode when the first end is pivoted toward the reproducing machine for restacking individual originals and in the second mode when the first end is pivoted away from the reproducing machine to expose the second portion of the tray for restacking fan-folded originals.

4. The apparatus of claim 3, wherein the first portion comprises a groove defined in the second end of the tray for restacking the individual originals.

5. The apparatus of claim 4, wherein the groove is defined by first and second rows of spaced flanges, the flanges of the first row being plates having aligned surfaces defining a plane which extends parallel with respect to the axis about which the tray pivots and extending at an oblique angle with respect to the horizontal when the tray is in the first mode, and the flanges of the second row defining an acute angle with those of the first row.

6. The apparatus of claim 5, wherein the means for facilitating restacking individual originals includes a slide surface oriented in a direction substantially coextensive with that of the plane defined by the first row of flanges when the tray is positioned in the first mode.

7. The apparatus of claim 6, wherein the feeding means includes a tractor assembly disposed between the slide surface and the pivot means for positively engaging the fan-folded originals as the fan-folded originals emerge from the reproducing machine to advance the fan-folded originals to the second portion of the tray.

8. The apparatus of claim 6, wherein the means for facilitating restacking of individual originals includes at least one flexible member overlying the slide surface for retaining the individual originals against the slide surface as the individual originals emerge from the reproducing machine.

9. The apparatus of claim 8, wherein the means for facilitating restacking of the individual originals further includes means for mounting the flexible member for retraction from an operational position when the tray moves from the first mode to the second mode.

10. The apparatus of claim 9, wherein the means for mounting the flexible member includes means engageable by the tray and connected to the mounting means for moving the mounting means and flexible member secured thereto away from the tray when the tray is in the second mode.

11. The apparatus of claim 10, wherein the mounting means includes a rod which extends transverse with respect to the slide surface and is secured to a pair of pivoted arms disposed proximate opposite sides of the slide surface; means for connecting the pivoted arms together to pivot in unison; the means engageable by the tray being a rod connected at one end to one of the arms and having the other end thereof disposed adjacent to the tray for engagement therewith for pivoting the arms to retract the flexible member when the tray moves to the second mode.

12. The apparatus of claim 11, further including spring means for biasing the mounting means to position the flexible member in the operational position and means connected to the mounting means in opposition to the spring means for damping acceleration of the mounting means.

13. The apparatus of claim 12, including spring means disposed between the rod and tray to absorb impacts between the tray and rod.

14. The apparatus of claim 13, wherein there are at least two, spaced-apart flexible members.

15. Apparatus for restacking both individual originals and fan-folded originals after a reproducing machine has copied the originals, comprising:

a base securable to the reproducing machine at a location on the reproducing machine where copied originals emerge from the reproducing machine, the base having a lower end and an upper end;

means mounted on the base for feeding fan-folded originals;

a tray having first and second ends, the first end being pivoted to the base adjacent the lower end of the base for allowing the tray to pivot between a first mode wherein the tray is positioned to provide for the restacking of individual originals, and a second mode wherein the tray is positioned to provide for the restacking of fan-folded originals fed by said fan-fold feeding means; and means associated with the base for facilitating restacking of individual originals.

16. The apparatus of claim 15, wherein the tray includes means proximate the second end thereof for restacking individual originals and means between the first and second ends of the tray for restacking fan-folded originals.

17. The apparatus of claim 16, wherein the feed means includes a tractor assembly disposed in the base between the lower and upper ends thereof, the tractor assembly being exposed for use upon pivoting the tray from the first mode for restacking individual originals to the second mode for restacking fan-folded originals.

18. The apparatus of claim 17, wherein the base includes a slanted surface adjacent to the upper end thereof and wherein the means for facilitating restacking of individual originals includes means overlying the slanted surface for retaining individual originals between the slanted surface and overlying means.

19. The apparatus of claim 18, wherein the overlying means includes mounting means therefor and means engageable by the tray for moving the mounting means to shift the overlying means to an operative position or to an inoperative position upon the tray being pivoted respectively to the first mode or to the second mode.

20. In combination:

a reproducing machine for copying both individual originals and fan-folded originals;

a base securable to the reproducing machine at a location on the reproducing machine where copied originals emerge from the reproducing machine, the base having a lower end and an upper end;

means mounted on the base for feeding fan-folded originals;

a tray having first and second ends, the first end being pivoted to the base adjacent the lower end of the base for allowing the tray to pivot between a first mode wherein the tray is positioned to provide for the restacking of individual originals, and a second mode wherein the tray is positioned to provide for the restacking of fan-folded originals fed by said fan-fold feeding means; and means associated with the base for facilitating restacking of individual originals.

21. The combination of claim 20, wherein the tray includes means proximate the second end thereof for restacking individual originals and means between the first and second ends of the tray for restacking fan-folded originals.

22. The combination of claim 21, wherein the feeding means includes a tractor assembly disposed in the base between the lower and upper ends thereof, the tractor assembly being exposed for use upon pivoting the tray from the first mode for restacking individual originals to the second mode for restacking fan-folded originals.

23. The combination of claim 22, wherein the base includes a slanted surface adjacent to the upper end thereof and wherein the means for facilitating restacking of individual originals further includes means overlying the slanted surface for retaining individual originals between the slanted surface and overlying means.

24. The apparatus of claim 23, wherein the overlying means includes mounting means therefor and means engageable by the tray for moving the mounting means to shift the overlying means to an operative position or to an inoperative position upon the tray being pivoted respectively to the first mode or to the second mode.

25. The combination of claim 24, wherein the means overlying the slanted surface comprises flexible web means; the mounting means comprises a horizontal rod extending across the slanted surface, and the means engageable by the tray for moving the mounting means comprises a vertically disposed rod connected to the horizontally disposed rod by a linkage which moves the horizontally disposed rod and flexible web means mounted thereon from the operative to the inoperative position upon the tray being pivoted from the first to the second mode.

* * * * *